US005096334A

United States Patent [19]

Plank

[11] Patent Number: 5,096,334

[45] Date of Patent: Mar. 17, 1992

[54] SHORING SHIELD

[76] Inventor: Michael J. Plank, P.O. Box 262591, Houston, Tex. 77207

[21] Appl. No.: 590,143

[22] Filed: Sep. 28, 1990

[51] Int. Cl.[5] ..... E02D 17/04

[52] U.S. Cl. ..... 405/283; 405/272; 405/282

[58] Field of Search ..... 405/283, 282, 273, 272, 405/258, 302, 303

[56] References Cited

U.S. PATENT DOCUMENTS

| | | | |
|---|---|---|---|
| 2,922,283 | 1/1960 | Porter | 405/283 |
| 3,204,415 | 9/1965 | Hill et al. | 405/283 |
| 3,766,740 | 10/1973 | Teegen | 405/282 |
| 3,791,151 | 2/1974 | Plank | 405/282 |
| 4,376,599 | 3/1983 | Krings | 405/282 |
| 4,682,914 | 7/1987 | Aihara et al. | 405/283 |
| 4,787,781 | 11/1988 | Bradberry | 405/282 |

FOREIGN PATENT DOCUMENTS

| | | | |
|---|---|---|---|
| 1459090 | 10/1982 | Japan . | |
| 2095719 | 10/1982 | United Kingdom | 405/283 |

*Primary Examiner*—Dennis L. Taylor
*Attorney, Agent, or Firm*—Matthews & Assoc.

[57] ABSTRACT

The present invention comprises a lightweight, portable, adjustable, reusable, preassembled, hydraulic expandable shoring shield for providing safety to personnel working in below-grade excavations. The Shoring shield comprises specially designed solid aluminum extruded sheeting sections forming the walls, each mounted with a top cap and lower skid, the walls are provided with a static expandable telescoping structural framework for holding the walls opposed, and also are provided with hydraulic cylinders for expanding the space enclosed between the walls, the framework and cylinders thus cooperate in combination with an armored manifold for routing fluid to the cylinders.

11 Claims, 4 Drawing Sheets fig. 8
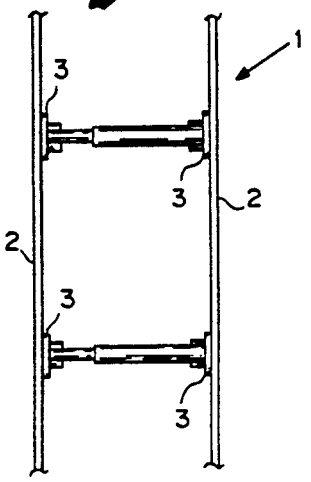
fig. 9
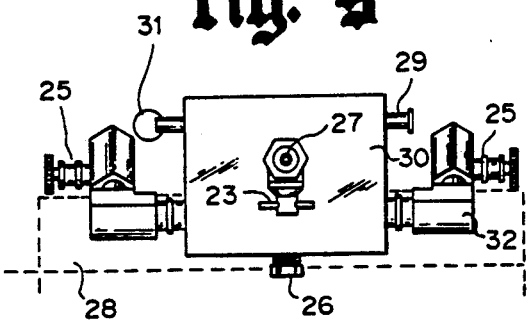
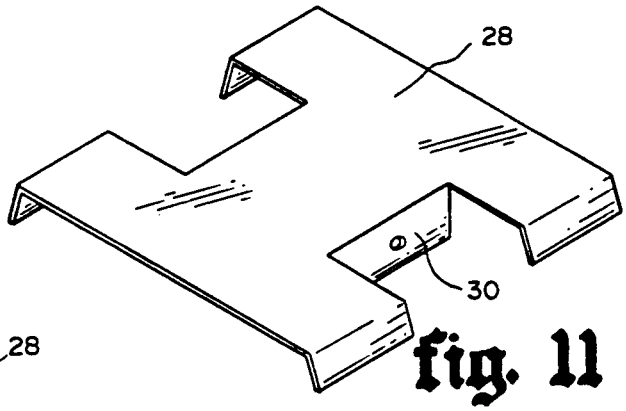
fig. 11
fig. 10
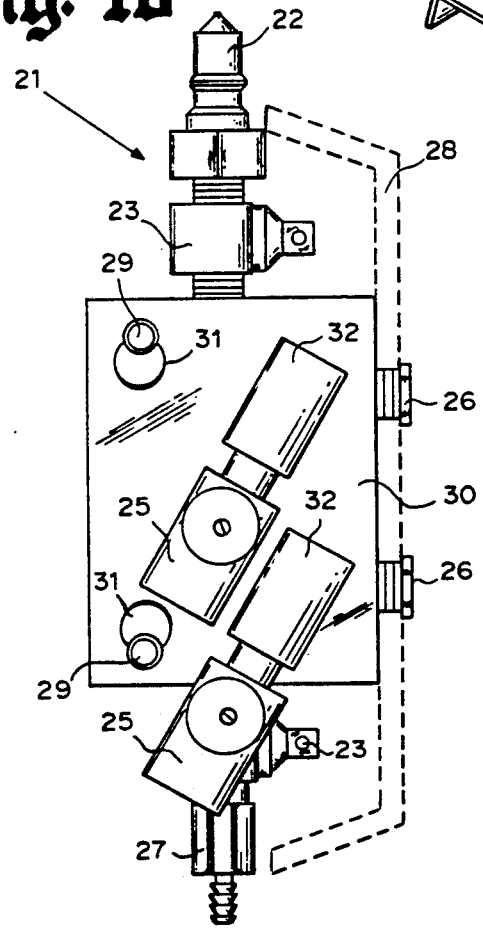
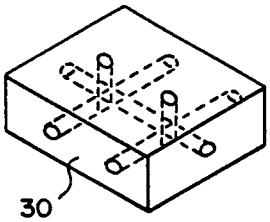
fig. 12 fig. 13
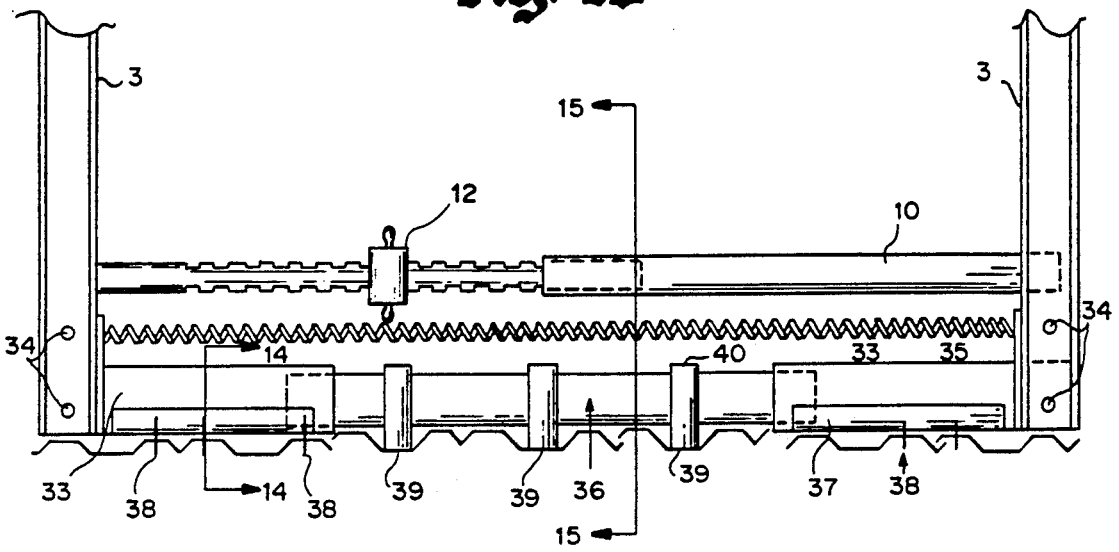
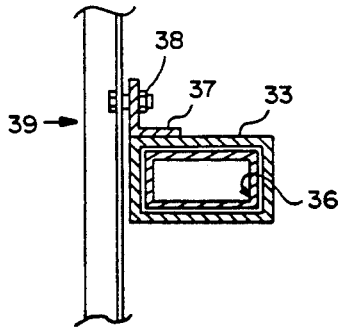
fig. 14
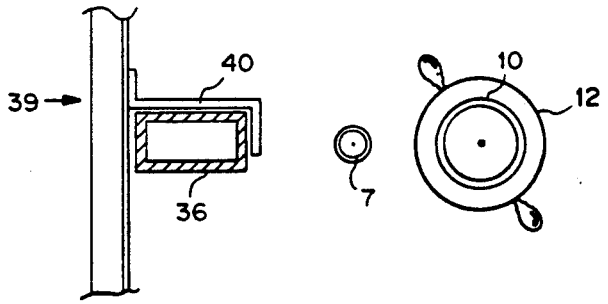
fig. 15

SHORING SHIELD

BACKGROUND AND PRIOR ART

This invention relates to a new and improved device to provide enhanced worker protection when workers are doing any type of work in excavations such as below ground repairs, including maintenance or installation of any type such as trenching, bore-pits, manhole installations, or pipe or pipeline maintenance work. More particularly, this invention relates to an improved shoring device, of the type having pairs of elongate rails and extendable and contractible cross braces connected at opposite ends to the rails, which device is lowered and raised into and out of below grade working sites such as into and out of a trench to a position between the trench walls, which device is adapted when extended to hold shoring shields tightly against the walls. This device can be provided with or without hydraulic extendable actuators, with or without positive locking devices, and with or without springs positioned and situated so as to collapse the cross braces and pull the shoring shields away from the walls of the trench (or other excavation). The device further relates to a new and improved method and apparatus of armored and protected hydraulic valving manifold and protected hydraulic fluid lines for use with the improved shoring device of this invention, or for use with other such hydraulic shoring devices as are presently used.

Presently available excavating equipment permits digging rapidly so that work can be done and the excavation immediately refilled. However, installations may require personnel to enter into the excavation which can be rather deep or through unstable soil, and cave-ins of the excavation not only interfere with the maintenance or construction operations, but may cause serious injury, or even loss of life to working personnel. The various types of prior art devices which are utilized in these maintenance and construction trenching or excavation shoring operations are characterized by devices of the types illustrated and described in U.S. Pat. No. 3,791,151, issued to David O. Plank Feb. 12, 1974; U.S. Pat. No. 3,224,201 issued to Brunton in December, 1965; U.S. Pat. No. 3,335,573 to Ward issued Aug. 15, 1967; U.S. Pat. No. 3,347,049 to Faltersack et. al issued Oct. 17, 1967; U.S. Pat. No. 3,851,856 to Berg issued Dec. 3, 1974; and U.S. Pat. No. 4,787,781 to Bradberry issued Nov. 29, 1988. Various types of devices of this sort are known worldwide as evidenced by Japanese Patent 1459090 for a Hydraulic Expansion Beam for a Shoring Strut in the name of Osaka Gas Company Ltd. invented by Takashi Fukumori, Maso Koide and Kenichi Fukumori issued Oct. 28, 1982. Each and all of these references are hereby incorporated by reference for all purposes.

As described in the above references there exist various types of shoring devices, usually incorporating hydraulic jack parallelogram arrangements which are used for shoring the sides of trenches or excavations. One type of common device utilizes a pair of horizontally disposed vertically spaced hydraulic cylinder and piston units pivotally connected at their opposite ends to shoring rails which extend vertically and which will be held against opposite sides of the trench when the hydraulic cylinder and piston units are expanded. Another type of common device uses a pair of horizontally disposed horizontally spaced hydraulic cylinder and piston units connected pivotally at their opposite ends to horizontal shoring rails which abut against shoring timbers or sheeting which are vertically disposed at opposite sides of the trench. Both these types operate so that the cylinder and piston units act as cross braces extending across the trench. After the devices are inserted into the trench, hydraulic fluid is pumped into the cylinders to force the pistons to extend, and thereby to jack the shoring rails apart to the desired extent, and thereby hold the shoring upright rails or shoring boards tightly against opposite walls of the trench to prevent sloughing of the material behind the boards.

Various combination hydraulic jack and piston and cylinder assemblies may be used or may be modified for use with devices according to the present invention are represented by the inventions described and claimed in U.S Pat. No. 3,224,201 to Brunton issued Dec. 21, 1965, U.S. Pat. No. 3,321,182 to Elenburg issued May 23, 1967; U.S. Pat. No. 3,851,856 to Berg issued Dec. 3, 1974; U.S. Pat. No. 3,905,279 to Yadon issued Sept. 16, 1975; U.S. Pat. No. 4,247,082 to Sjolund issued Jan. 27, 1981; and, U.S. Pat. No. 4,449,734 to Cory issued May 22, 1984, and each and all of these references are hereby incorporated by reference for all purposes.

As described by the references in the preceding paragraph, there exist various types of hydraulic jacking units which are provided with assorted positive supporting mechanisms to lock the jack into extended position of the piston and cylinder units so as to prevent retraction of the piston into the cylinder even in the event of pressure loss or release from the cylinder.

Notwithstanding the various devices referred to above and other devices known to those of skill in the art of trenching, shoring and safely working in excavations below grade, various problems associated with devices in use at present are solved by the new and improved shoring shield of the present invention. The new and improved shoring shield of the present invention provides a light weight, portable, adjustable, reuseable, preassembled shoring system that can be quickly installed and removed. Further, it provides increased strength and durability, increased rigidity, and features easier and more adaptable installation capabilities and easier, simpler and safer operating due to the improved armored manifold valving and hydraulic lines, and far superior due to the continuity and new and improved section design of the solid sheeting.

Full appreciation of the present invention and its advance of methods and devices commonly used in the art can best be appreciated as set out in more detail below with references to the accompanying drawings.

BRIEF DESCRIPTION OF THE DRAWINGS

FIG. 8 is an end view cross section of the aluminum shoring shield of FIG. 1;

FIG. 9 is a plan view of the armored manifold of the present invention;

FIG. 10 is a side view of the armored manifold of the present invention;

FIG. 11 is a perspective view of the manifold armor;

FIG. 12 is a ghost perspective view of the manifold block;

FIG. 13 is a plan view of an embodiment of an end panel for use with the present invention;

FIG. 14 is a cross-section through a portion of FIG. 13; and,

FIG. 15 is a cross-section through FIG. 13.

SUMMARY OF THE PRESENT INVENTION

Figure 3:
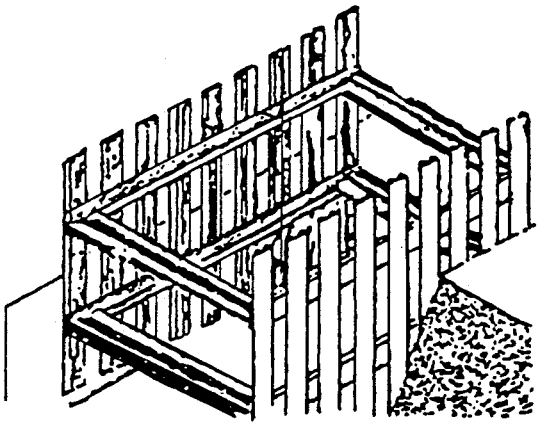
fig. 3 Prior Art
FIG. 3 is a perspective view of a prior art skeleton box device being lowered into a trench.
Figure 4:
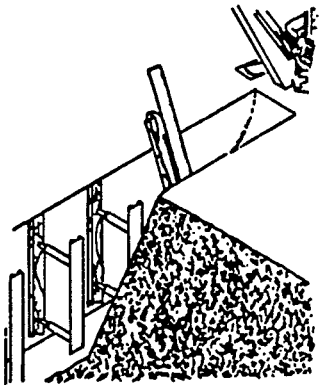
fig. 4 Prior Art
FIG. 4 is a perspective view of a prior art series of vertical shores being placed in a trench.
Figure 5:
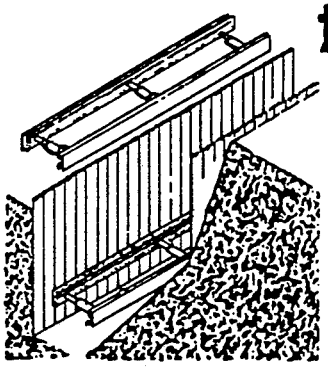
Prior Art fig. 5
FIG. 5 is a perspective view of a pair of horizontal wales being placed into an excavation to hold timbered walls in place.

With reference now to the details of the above described drawings and, with the above references in mind a brief discussion of the evolution of shoring shields is in order. The new and improved shoring shield of the present invention is indicated in its entirety by reference character 1, shown in its entirety in FIG. 1 and in various views in FIGS. 6, 7 and 8. Various prior art approaches to the problem of sloughing and caving in of trenches and excavations are illustrated in FIGS. 3, 4 and 5. Hydraulic cylinders connected to rails are key components of any trench shoring system. A pair of cylinders connected to a pair of rails which are positioned vertically as several (three or more) vertical shores make up a minimal trench safety system as illustrated in FIG. 4. This shoring system became the state of the art in trench shoring safety systems years ago. These hydraulic shoring systems, with aluminum rails and hydraulic cylinders were a fundamental improvement over trench shoring systems made of heavy timbers (not shown), reducing the weight of systems while maintaining and/or increasing the shoring capacity of the systems. These vertical shores could be quickly installed and removed in trenches from an above ground, safe location as illustrated in FIG. 4, whereas the installation of timber shoring systems was time consuming and required installers to work in unsafe conditions below grade within the trench pit or excavation.

Vertical shores are most commonly used in relatively stable unsaturated soils. For less stable soils other solutions were necessary. Wales outfitted with hydraulic cylinders in many respects are similar to vertical shores. However, wales were used more in less stable soil conditions, installed in a horizontal position normally holding timbered walls or steel sheeting in place as illustrated in FIG. 5. Additional wales could be installed horizontally for use with longer timbers as depths increased.

Variations of vertical shores and wales with vertical timbers or sheeting have been used for some time. The next step in the evolution of trenching shoring devices was the skeleton box, illustrated in FIG. 3, which combines some of the capabilities of both vertical shores and wales. The skeleton box utilizes the horizontal rails of a wale in combination with the vertical shore rails for heavy duty strength. These skeleton boxes developed in response to the need for a lighter weight preassembled, adjustable portable shoring system, and the skeleton box has served for installation and repair jobs over the past decade, however problems remained unsolved by the skeleton box.

The skeleton box (FIG. 3), although quicker to install than the wale system used with vertical timbers or steel sheeting, unless the skeleton box was also used with timbers, steel sheeting, or plywood or Finn-Form walls the skeleton box could not provide the same support for unstable soils as the prior art wale and sheeting system. If the skeleton box was used in combination with Finn-Form, plywood or steel sheeting walls the combination provided little improvement over the wale and sheet wall prior devices in either weight or complexity and ease of installation.

Notwithstanding the various devices referred to above, and other devices known to those of skill in the art of trenching, shoring, and safely working in excavations below grade, there are problems which are solved by the new and improved shoring shield of the present invention. The new and improved shoring shield of the present invention maintains the light weight, portable adjustable, reuseable preassembled capabilities of the skeleton box, and further it provides a specifically designed solid wall which has a cross-section that increases the strength and durability of the shoring device as compared to the skeleton boxes ribbed rails, with or without plywood or Finn-Form walls, while at the same time it provides additional room within an excavation of a given size due to its narrower profile compared to previous combinations. In addition, the shoring shield of the present invention is provided with caps and skids to the specially designed wall sections, which further increases the rigidity of the walls, prevents damage to sheeting, provides an additional capability over the skeleton box in that the shoring shield of the present invention, unlike any previous devices can be skidded along the bottom of a trench. The shoring shield of the present invention is further provided with a new and improved manifold which distributes hydraulic fluid into and out of the hydraulic cylinders. The manifold features a clean easily manufactured and modified design and includes an armored guard to protect the manifold and valves from damage, and the hydraulic lines from the manifold to the actuating cylinders are further protected to minimize the possibility of any damage to the hydraulic system. Also skeleton boxes could only be utilized to bear against the two open sides of a trench and no provision was made for end supports as at the ends of a trench. The present invention also provides for special end plates. The overall combination of the present invention provides numerous features, such as for example the positioning lock square box tubing which locks shield in place assuring no collapse under hydraulic failure each advancing the art of protecting workmen in excavations and in trenching maintenance and repair operations, and the combination achieves significant improvement over traditional shoring methods while allowing above ground installation, hydraulic pre-load of excavation walls to prevent ground movement, reduction of the size of the shoring crew, and increasing efficiency, production and profit.

The present invention comprises pairs of wale rails oppositely mounted facing one another on facing shoring shield side walls. Facing shoring shield side walls built up from overlapping narrow corrugated sheets fastened to the wales are connected into a box like structure by telescoping cross members mounted to the wales so as to extend from one shoring shield side wall across an excavation to another shoring shield side wall. Adjacent to each cross member are attached in tandem with the cross member both a hydraulic piston and cylinder unit, which can be actuated so as to cause the telescoping cross member to extend and thereby also to cause opposite shoring shields to be pressed against opposite walls of an excavation, and a return spring, which will cause the telescoping cross members to collapse upon the release of hydraulic pressure to the actuating cylinders. Since it is normally desireable to actuate each of the hydraulic cylinders simultaneously with one another, the present invention is further provided with a special armored manifold and valve set up, and with protected hydraulic lines to each of the hydraulic piston cylinder units. The manifold permits attaching a single hydraulic line to a shoring shield device at a single convenient location and when hydraulic pressure is applied through that line, the manifold device and armored hydraulic lines to each of the cylinders causes all cylinders to actuate and extend simultaneously. The manifold can also be provided with shut off valves for any individual cylinder, and in addition the manifold can be configured for operation with double acting hydraulic cylinders so that the pressure applied through the manifold can selectively cause the cylinders either to extend or contract as desired.

A more specific description of the invention and its use follows.

DETAILED DESCRIPTION OF THE PREFERRED EMBODIMENT

Figure 1:
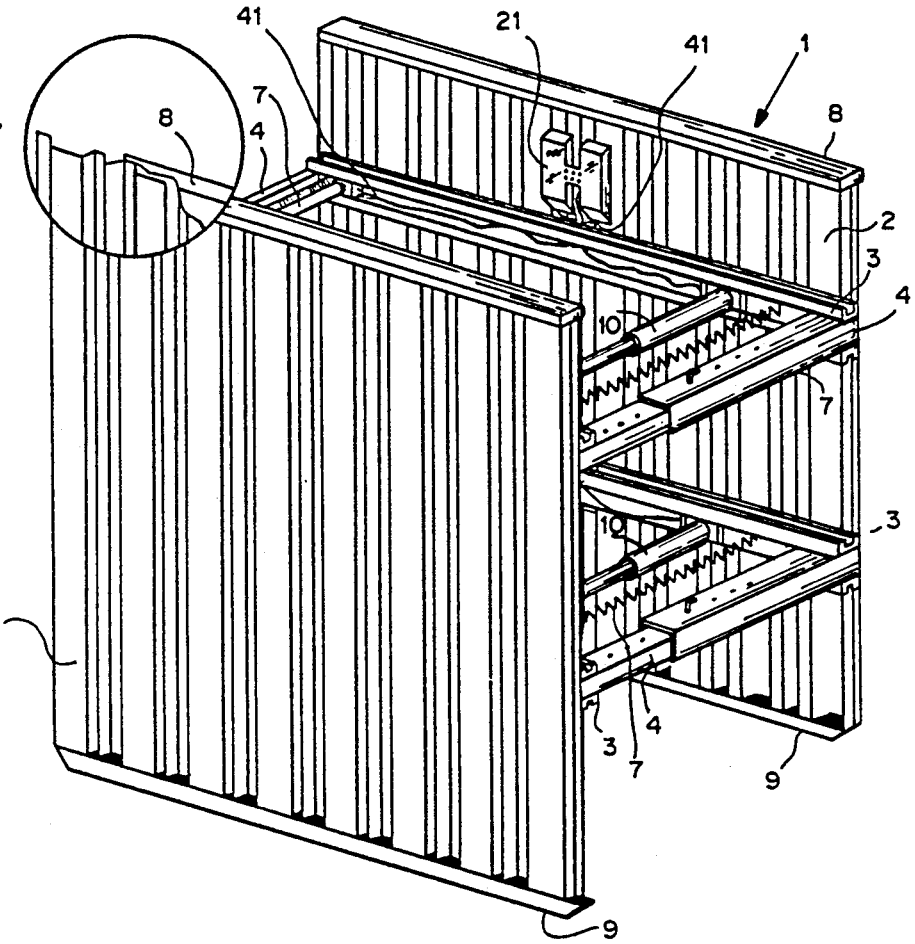
FIG. 1 is a perspective view of the new and improved shoring shield and armored manifold and hydraulic lines constructed in accordance with the present invention.

FIG. 1 illustrates in perspective the combination device of the present invention, indicated generally by reference numeral one. The device comprises two solid shoring shield side walls 2. Each of the shoring shield side walls 2 is provided upon one face of each wall with a pair of rails or wales 3 which in the preferred embodiment illustrated are mounted generally parallel to one another so as to be horizontally positioned when the improved shoring shield device is installed in an excavation. The frame work or wales 3 in the preferred embodiment are made of 6061-T6 aluminum alloys in consideration of weight strength, flexural properties and non-corrosive characteristics. Modular "hat section" sizes allow a standard wale 6 inches wide by 3 inches deep ($S_x$ 3.67 in.$^3$), a medium duty wale 6.3 in. wide by 4.2 inches deep ($S_x$ 7.5 in.$^3$), and a heavy duty wale 8.1 inches wide by 5 inches deep ($S_x$ 14.06 in.$^3$). The heavy duty wale rails 3 shall preferably be no less than 8" in width and should preferably have an equivalent strength not less than that of a 12" by 16" Douglas Fir timber with its narrow side to the trench wall, for allowable stresses as outlined in the Federal Uniform Building Code.

Figure 7:
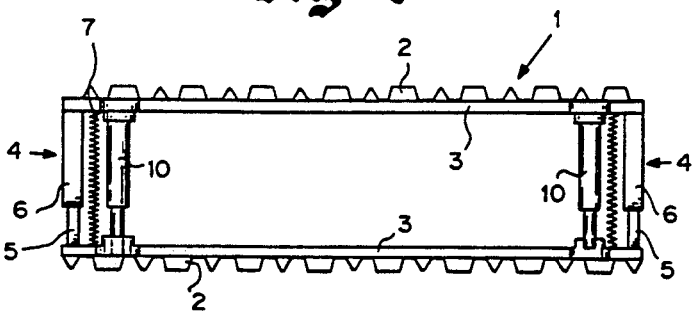
FIG. 7 is a plan view of the aluminum shoring shield of FIG. 1.

The opposing facing shoring shield side walls 2 with their mounted wales 3 are connected into a box like structure 1 by telescoping cross members 4 constructed from cylinders or box tubing and attached so that the unit formed of interior 5 and exterior 6 components forms a unit 4 expandable in one direction across the width of the trench as illustrated in FIG. 7. The lateral telescoping cross members optionally feature positive mechanical lock settings 12 for mechanically locking the shoring shield device at various widths through its span of travel. FIG. 13. The use of these positive lock devices 12 allows the unit to become a static trench shield. The box like structure may also be provided with closure springs 7 to collapse the box to its narrowest width for insertion or removal from an excavation. The preferred embodiment utilizes coiled steel springs 7, with one spring 7 mounted proximate each of the cross member unit 4 hydraulic cylinder 10 pairs. FIGS. 1, 7 and 13.

Figure 6:
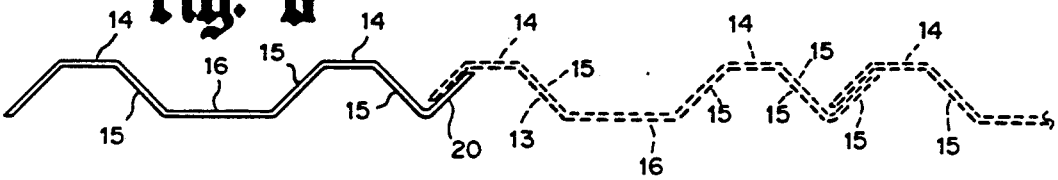
FIG. 6 is a cross-section through wall segments of the shoring shield of the present device.

Referring now to FIG. 6, it should be appreciated that FIG. 6 illustrates in cross-section a segment of the solid formed or corrugated aluminum sheeting component a preferred embodiment for the side walls of the present invention. As illustrated in FIG. 1, the aluminum shoring shield of the present invention is a specially designed extruded aluminum shape and is designed to insure light weight, durability, non-corrosiveness, and sufficient shoring support for highly unstable soils.

The walls 2 of the improved shoring shield device 1 of the present invention are built up from specially designed overlapping solid aluminum formed or corrugated narrow sheets. FIG. 6 illustrates two basic segments of the corrugated extruded aluminum sheets in cross-section, with the dashed line ghost view indicating the means for extension of the wall by overlapping sheets. Additionally, the present invention comprises caps 8 and skids 9 which are mounted to the top and bottom edges respectively of each of the shoring shields 2 as illustrated in FIG. 1. The addition of caps and skids to the specially designed formed sheeting of the shoring shield walls provides a substantial increase in rigidity and positive protection for the sheeting in comparison to the prior art skeleton boxes. The increase in rigidity plus the skidding action allows the improved shoring shield of the present invention to be easily dragged along the bottom of a trench, whereas a skeleton box could not be so shifted and adjusted.

Referring to FIG. 6 and running from left to right, it can be observed that there are eight subsegments to the corrugated sheet basic segment illustrated. In the preferred embodiment the sheet is formed of 6061-T6 aluminum 0.20 in. in thickness, and given the segments 13, 14, 15, 16, 17, 18, 19 and 20 illustrated in FIG. 6, the approximate length of each of the segments respectively is 0.87 in., 1.61 in., 1.81 in., 3.23 in., 1.81 in., 1.61 in., 1.81 in., and 0.87 in. The radiuses joining adjacent segments are 0.25 in. The overall length from left to right of the sheeting basic segment section illustrated is 11.81 in. Adjacent segments are at 45° relative one to another. In the preferred embodiment of the present invention (FIG. 1) the basic sheet illustrated in FIG. 6 would be overlapped (subsection 20 of any given segment would overlap subsection 13 of the next segment to the right). Alternatively each shoring shield 2 could be formed of a single extruded solid sheet, corrugated with the pattern illustrated in FIG. 6, but repeated in sequence along the trench length of the shoring shield panel. The overlapped sheeting segments permit the length of any given shoring shield unit 1 to be arrived at by using the proper number of segments for a panel, similar to the end panels that will be further described below. The illustrated embodiment of a basic narrow segment utilizes a total section height of 1.38 in. The section modulus of sheeting of this configuration is 1.0042 in.$^3$, moment of inertia is 0.6929 in$^4$. The preferred embodiment of the present invention would utilize aluminum sheeting of the section described with the previously described aluminum wales wherein the standard wale would have a section modulus of 3.67 in.$^3$, a medium duty 7.5 in.$^3$ and a heavy duty embodiment of the aluminum wale would have a section modulus of 14.06 in.$^3$. The narrow basic sheets would be bolted 42, FIGS. 1, 6 and 7, through the face of the sheet to the two wales, then the next sheet would be overlapped and bolted to the wales to form a solid faced wall.

The small dimension of the total section height (1.38 in.) is a thinner profile which although thinner than all prior art shoring devices is also stronger than all prior art shoring devices. The thinner profile gives more room in the trench making it easier for workmen to do their jobs, and allowing work on larger pipes or other structures. Even though the profile is thinner, it is a much greater strength as compared to prior art shoring devices and skeleton boxes, allows the height of the lower wale above the ground to be raised. This also increases clearance above pipe or other existing structure so that a larger pipe can be worked on or installed, allowing applications that were impossible with the prior art devices.

In the preferred embodiment the telescoping cross members are constructed of square box steel tubing attached end to end to form a unit expandable in one direction, and in the preferred embodiment featuring a minimum of three positive lock settings for adjusting the locked width of the device through it travel. The telescoping cross members in the primary embodiment would be constructed of 3½" by 3½" by 3/16" square steel tubing for the exterior element 6, and 3" by 3" by 3/16" square steel tubing for the interior element 5.

Mounted proximate to each cross member unit is a hydraulic cylinder attached at each end to an opposing wale generally parallel to the cross member unit. The preferred embodiment uses 2" or 3" I.D. aluminum hydraulic cylinders with each cylinder 10 having the working strength of not less than 18,000 pounds for the 2" diameter, or 30,000 pounds for the 3" diameter axial compressive load (safe working loads) at maximum extension respectively. The strength gives a safety factor of 1.5, and the use of these hydraulic cylinders 10 causes the unit to become a trench shoring device as its sides become pressed against the walls of the trench. The cylinders 10 allow hydraulic pre-load of the excavation walls to prevent or at least minimize ground movement. The device 1 is expanded by injecting hydraulic fluid with a hand pump or powered pump into each cylinder simultaneously through a special manifold 21 as will be described in more detail below. The cylinders 10 can optionally be furnished with aluminum over-sleeves for added support at maximum extension, and for protection of the piston rod through its complete stroke, and the cylinder can optionally be threaded on its exterior and provided with a further locking nut as in the Japanese reference 1,459,090. Aluminum alloys are considered preferable for the primary embodiment, giving due consideration to weight, strength, and non-corrosive characteristics. The cylinders preferably are fitted with a wiper guide assembly to thoroughly clean the smooth exterior of the piston rod before entering the cylinder, and the cylinder pad at the shoring device shall be a minimum of 2½" thick through its axis to assure sufficient columnar support of the cylinder barrel.

It can be appreciated that with the above described components the present invention is modular and can be provided in a variety of configurations by varying the number of cross member/cylinder/spring placements along wales, the number of wales, the height and running length of each aluminum sheet, and the number of sheets so that various excavations of varying length, height, and width can easily be accommodated.

Although custom configuration is easily achieved, and in fact will probably be desireable for many, if not most, of the installations, providing standard configurations would also be easy if such standard configurations were desired to be inventoried for immediate availability. Such configurations could provide a six foot height wherein four cylinders could accommodate, or could safely handle an excavation length of six, eight, ten, twelve or sixteen feet; units eight feet high with four cylinders could be provided to accommodate trenches of eight, ten, twelve, and sixteen feet in length; units ten feet high and provided with four cylinders could accommodate ten to sixteen feet in length, and units twelve feet high, and from twelve to sixteen feet long could be provided with six cylinders to utilize the standard sheeting and wale dimensions of materials previously described.

Figure 2:
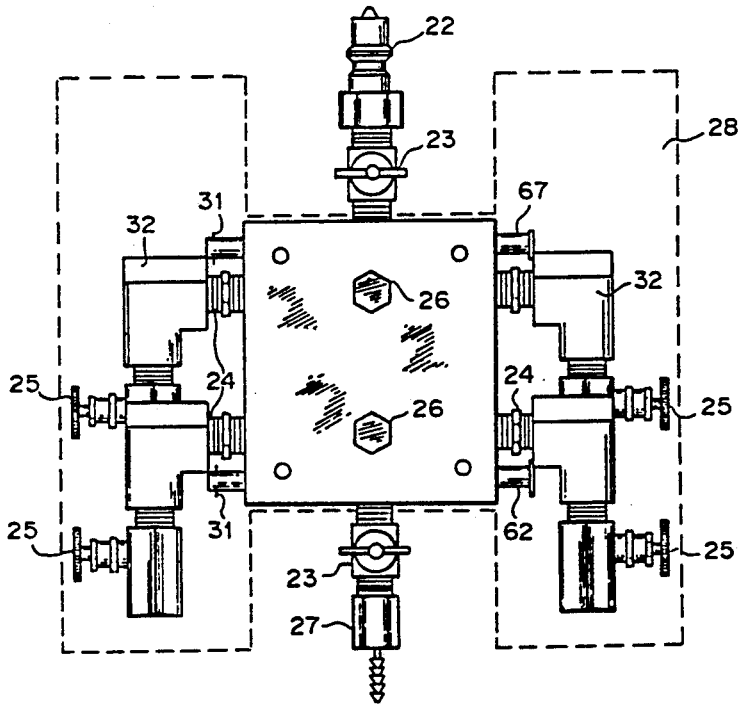
FIG. 2 is an elevational view of the armored manifold of the present invention.

Referring now to FIGS. 2 and 9 through 12, there are illustrated in four views the armored manifold for controlling the flow of the hydraulic fluid to the hydraulic cylinders of the present invention. FIG. 9 is a view from the top of the manifold, FIG. 10 is a side elevation, FIG. 2 is a frontal elevation, and FIG. 11 is a perspective view of the armor for the manifold.

A manifold system is used since although in most cases it is desireable to supply hydraulic fluid simultaneously at equal pressures to all hydraulic cylinders, it may desireable or in fact necessary to selectively control the flow. Examples of the need to selectively control the flow would occur in situations where perhaps one of the cylinders requires repair, it could be isolated, removed and repaired without removing or disturbing the hydraulic capabilities of the remaining cylinders. Another situation might occur if, for example, after operations within the excavation during removal of the shoring shield device, it might be necessary to selectively supply fluid pressure to individual hydraulic cylinders to aid in removal of the shoring shield from the excavation.

It should be appreciated that the manifold illustrated (FIG. 12) and associated valving are designed so that the hydraulic pressure can be introduced to a central convenient location on the shoring shield device, accessible from both within the excavation and above, and can from there be selectively distributed to the hydraulic cylinder units. An extension of the principals described and illustrated in a modular fashion could provide such a centralized location and uniform distribution for any number of cylinders, and although the embodiment described utilizes single acting hydraulic cylinders and coil springs for return, an extension of the principals described and illustrated could selectively supply hydraulic fluid to double acting hydraulic cylinders, and thereby allow both extension and contraction of the cross members hydraulic cylinders for installation and removal of the shoring shield device from an excavation.

The armored manifold device is indicated generally by reference number 21. The associated components of the armored manifold of the primary embodiment comprise a hydraulic quick connect coupler 22, two one-quarter turn shut-off valves 23, four heavy duty hex close nipples 24, four flow lock needle valves 25, two quarter inch pipe plugs 26, one female push on fitting 27, the armor shield 28, two connecting pins 29, the manifold block itself 30, two retainer rings 31, and four 90° elbows 32.

An understanding of the flow routing possibilities can be appreciated by referring to FIGS. 2, 9, 10 and 12 wherein the quick connect 22 at the top of the armored manifold would be used for connection to a hydraulic pressure source, either a hand pump or a powered hydraulic pump. It is envisioned that the primary embodiment would utilize a hydraulic pump with a minimum 5 gallon fluid capacity provided further with calibrated gauges, the hose, valves and fittings. The pump gauge should a minimum operating range of 750 to 1500 psi, the hose a minimum of twelve feet in length with cadmium plated spring guards, and a minimum working pressure of 5000 psi, with a burst pressure of 20,000 psi. Pump valves and fittings in the primary embodiment would be brass or cadmium plated for maximum life.

There are two quarter turn shut off valves 23 provided. One at the top of the manifold unit (referring to FIG. 10) for the supply circuit, and a second quarter turn shut off valve 23 which is located in the illustration below the supply shut off valve with the manifold block 30 interposed between the two shut off valves. Dashed lines in FIG. 12 (the manifold block 30) illustrate the flow paths provided therein. The quarter turn shut offs 23 and heavy duty hex close nipples 24 are threadedly attached to the manifold 30.

Fitted to each heavy duty hex close nipple 24 is a 90° elbow 32 to which is threadedly attached a flow lock needle valve 25. As illustrated in FIGS. 2, 9 and 10, two flow lock valves 25 are arranged on each side of the manifold block 30 in a symmetrical fashion. The flow lock valves 25 on a given side of the manifold block 30 are canted in a slight rearward direction, relative to the armor shield 28 which is placed at the front of the armored manifold 21 so as to protect the manifold, valves, and fittings. As illustrated in FIGS. 9 and 10 the valves on both the left and right sides of the manifold block 30 point in a general downward and backward direction relative to the top and face of the armored shield. The armor shield 28 can be of metal or preferably of a heavy duty, inexpensive plastic such as high molecular weight polyethylene or ultra high molecular weight polyurethane such as TIVAR, easily thermo-molded from sheets, provided with ultraviolet protection, and can be attached to the manifold block 30 by any suitable means such as by drilling and tapping holes into the body of the manifold and attaching the armor shield to the manifold block with cap bolts 41, FIG. 2.

The flow paths through the manifold, whereby the valves referred to are placed in fluid communication, is illustrated in FIG. 12. This is a primary embodiment, easily manufactured by drilling a solid block of metal or other suitable material, although those of skill in the art will realize alternate configurations fully consistent with the scope and spirit of this invention.

The manifold block 30 itself in the preferred embodiment can be made so that the width of the manifold block conforms to the interior clear width of a channel of a wale, so that a section or length of such a wale can be utilized as a mounting plate which can be bolted to one of the vertical sheets of the shoring shields 2. The manifold block may be held in place in the channel by two connecting pins 29 which are each pushed through holes at each side of the channel through a bore within the manifold block 30, and are retained in position by a retaining ring fitted through the end of each connecting pin. FIGS. 9 and 10. The connecting pins, combined with the positive mechanical locks of the cross members permit quickly removing the entire manifold/valve unit for replacement or repair.

The improved shoring shield device can optionally be provided with end walls. One embodiment of an end wall which can be used with the shoring shield device is illustrated in FIGS. 13 through 15. FIG. 13 illustrates in cross section a method and apparatus of attaching a hanger to one of the narrow sheeting panels, or segments 39 previously described (FIG. 6). A sufficient number of these segment panels 39 would be supplied to cover the maximum expanded opening possible at each end of the improved shoring shield device (as will be described in more detail below). The hydraulic fluid is supplied under pressure to each of the cylinders and as the trenching device expands, the end panels can be dropped into place where they simply hang over the end box cross members.

A specific embodiment would bolt a stub end beam 33 inside each end of each wale 3. Each end of the end beam 33 bolted to the wale 3 would be bolted to the wale with two one inch diameter bolts 34 spaced six inches apart. Gusset plates 35 one-quarter inch thick would be welded to the top and bottom of the $5\times3\times\frac{3}{8}$ outer end beam 33 to fit inside the wale 3. These plates would allow the bolts to be six inches apart and make the connection between the wales 3 and the outer end beams 33 a moment connection. The $4\times2\times5/16$ inner beam 36 would fit inside the outer beam and would be completely covered by the outer beam when the hydraulic cylinder was in the closed position. When the cylinders 10 expand the inner beam would be exposed. The extruded aluminum sheeting segment-panels 39 previously described (FIG. 6) would be bolted 38 to $2\times2$ angles 37 welded to the outer beams. This sheeting 39 could be left on the outer beams at all times. For the exposed part of the inner beam, aluminum z straps 40 would be welded to the extruded aluminum sheeting 37, and the sheeting placed on the inner beams 36 from the top of the trench. As the open width of the inner beam can vary from zero up, sheeting widths 39 the standard length of 11.81 in. and other sheeting pieces, 6 in. plus or minus wide, could be supplied to accommodate the opening as it gradually expands.

As can be seen in FIG. 1 hydraulic lines 41 are run from the armored manifold 21 to each of the hydraulic cylinders 10 through the protected channel provided by the wales 3 so that workmen can get into the protected space provided by the improved shoring shield of the present invention, and can move equipment, tools, and joints of pipe around as desired, without danger of damaging the relatively expensive hydraulic fluid components.

DESCRIPTION OF THE METHOD OF USE OF THE PRESENT INVENTION

To facilitate quick below ground repairs, maintenance or installation of any type for which worker protection may be necessary, one uses the improved shoring shield of the present invention. The person(s) using the device or site contractor or employee digs a trench, bore pit or manhole below the surface of the earth. Next the workmen attach a lifting harness or sling to the shoring shield device of the present invention utilizing lifting eyes which may be mounted conveniently on the horizontal wales. Next, the improved shoring shield is lifted, normally by a rubber tire backhoe, and placed into the trench or excavation, hydraulic shoring fluid is then pumped into the cylinders using either hand operated or powered hydraulic pump via the specially designed armored manifold. The fluid moves through the manifold simultaneously into each of the horizontally mounted hydraulic cylinders until a stable pressure (in the primary embodiment 750 pounds psi) is achieved in each of the cylinders. This pressure causes the cylinders to expand and press against the open opposing faces of the excavation to stabilize the soil and prevent sloughing or cave-ins into the excavation. All of the activity is performed by the workers safely above the trench or excavation. After the appropriate hydraulic pressure is achieved, workers may safely enter the work areas inside the new and improved shoring shield device. Optionally after or as the cross members are extended by actuating the hydraulic cylinders, end panels can be fitted into place if desired. After the work is completed a lifting harness is connected to the eye rings on the unit to facilitate its removal from the excavation. The steel retaining pins are then removed. Next the hydraulic fluid discharge valve on the six way manifold is opened manually and the coiled steel springs will then cause the side walls to contract facilitating removal of shoring shield from the trench. Once the width of the improved shoring shield device is less than the opening in the earth, the unit may be retrieved from the hole utilizing the previously attached lifting cables or harness, for example by utilizing the common rubber tired backhoe.

The overall combination of features comprising the new and improved trench shoring device of the present invention creates a most advanced, complete shoring/-shield system for small patch or repair, or other jobs in trench excavations. The improved device can be used either as trench shoring system or as a trench shield, and also could conceivably be used as a portable reusable collapsible framing device for pouring concrete or other type structures or fittings. The device can thus be used in general to restrain any type of material. The system can be stored, transported, used and re-used without disassembly. The modular nature of this system and its components allows adaptability to a wide variety of excavations. The specially designed aluminum sheeting creates a much narrower profile for the wall thickness than previously used thereby providing greater open work area inside a given excavation width. The special aluminum sheeting design provides a durable light weight siding, while increasing the strength of the walls compared to prior devices. As well, special sheeting provides for additional strength to permit higher clearance for large diameter pipes and the like, and the improved shoring shield of the present device has no need to be retro-fitted by exterior panels as do prior devices. An added feature is that the solid aluminum sheeting can provide a moisture barrier when used as a shoring system, and the increased rigidity resulting from the specially designed section of the aluminum wall sheeting and also due to the skids and caps mounted on the bottoms and tops of the side walls allows the improved shoring device to be dragged along the bottom of a trench, an impossibility with prior devices. The shoring shield device has an adjustable width dependent upon the stroke range of the hydraulic cylinders used, and cylinders can easily be provided with extensions to increase the width, and thereby the working space in the interior of the improved shoring shield device. Although this device in the primary embodiment is constructed with hydraulic cylinders it could be constructed without, and also the device can be provided with or without positive locking devices.

The new and improved shoring shield device can also be used as a static shield without hydraulic cylinders and return springs. The unit can be used in its fully contracted position or in a telescoped position. Any suitable means can be used to expand the width of the shoring shield as desired. Once the appropriate width is achieved, steel locking pins are placed in the pre-drilled holes in the square telescoping tubing cross members which locks the cross members and causes the unit to become a static trench shield instead of a hydraulic trench shoring device. When used as a static trench shield the sides of the unit are not pressurized against the trench walls.

By modifying the skid mounted to the bottom of any given shoring shield device, and by providing an appropriate bracket near the top of a second shoring shield device and with appropriate connections, the new and improved shoring shield device of the present invention allows for interconnected stacking of one device on top of another to vertically extend protection provided to workers in an excavation, although the shields without modified skids can easily be stacked when used in a pressurized mode and trench wall forces will prevent stacked devices from shifting.

While the invention has been described by means of a specific preferred embodiment and various alternative examples, it is not to be limited thereto. Obvious modifications will occur to those skilled in the art without departing from the scope of the invention.

What is claimed:

1. A device for shoring the walls of an excavation comprising:
   (a) spaced shield means for insertion into the excavation for support of opposing side walls of the open excavation;
   (b) support means mounted upon each of said shield means;
   (c) telescoping cross members mounted to said support means of each of said walls and extending across the space to form a box like structure expandable in one direction across the width of the excavation;
   (d) means for extending and contracting said cross members across the width of the excavation; and,
   (e) means for selectively applying, monitoring, adjusting and releasing a precise pressure to said open excavation walls said means comprising combination manifold means and valve means providing for at least one attachment point for a hydraulic pressure source.

2. The invention of claim 1 wherein said means for extending the telescoping cross members comprises hydraulic cylinders mounted across the width of the excavation proximate to and in tandem with each of said telescoping cross members, and wherein said means for contracting said cross members comprises coiled tension springs mounted generally parallel with, to said hydraulic cylinders and said telescoping cross members.

3. The invention of claim 1 wherein said means for expanding and contracting said cross members comprises double acting hydraulic cylinders mounted generally parallel to said telescoping cross members, which can selectively extend or contract in response to hydraulic pressure.

4. The invention of claim 1 further comprising:

(a) means for simultaneous supply of hydraulic pressure equally to each of said hydraulic cylinders and selective pressure to isolated cylinders;

(b) protective armor means for said combination manifold means and valve means;

(c) hydraulic lines for connection of said combination manifold and valve means to each of said hydraulic cylinders; and, (d) means for protecting substantially the entire length of each of said hydraulic lines.

5. The invention of claim 1 further comprising positive lock means for mechanically locking said shoring device into a selected position within its range of expansion.

6. The invention of claim 4 wherein said means for positive mechanical locking comprises holes formed at selected locations through said telescoping cross beams and locking pins for insertion into said holes drilled through said telescoping cross members to pin said telescoping member into a unit of fixed length.

7. The invention of claim 6 wherein said positive mechanical locking means comprises a jam nut threadedly connected to the exterior body of each of said hydraulic cylinders for threaded movement lengthwise of the cylinder body wherein said nut is engagable with the end of a hydraulic cylinder piston rod guard to prevent contraction of the cylinder.

8. The invention of claim 1 further comprising cap elements affixed to the tops of each of said shield means, skid members affixed to the lower edges of each of said shield means, and end plate means for optional walled protection across the width of the excavation, generally parallel to said cross members.

9. The invention of claim 1 wherein said shield means comprises solid panels of extruded corrugated aluminum.

10. The invention of claim 9 wherein side panels, and wales are formed of 6061-T6 aluminum and wherein said corrugation pattern of said side walls comprises segments which repeat et seq along the length of said wall.

11. A method of shoring an excavation comprising the steps of:

(a) forming shield means;

(b) interconnecting said shield means with telescoping cross members to form a two sided box like structure;

(c) fitting said cross members with extension means and contraction means and control means to expand the structure across its width and to retract the structure as desired;

(d) lowering said device into an excavation;

(e) actuating pressurizing means through said control means to expand said cross members and cause outer faces of said shield means to press against opposite faces of an excavation;

(f) continuously actuating said pressurizing means until said shield means press against opposite faces of said excavation at a precise predetermined pressure; and, (g) monitoring and adjusting said actuating means to maintain said predetermined pressure against said excavation walls.

* * * * *

UNITED STATES PATENT AND TRADEMARK OFFICE

CERTIFICATE OF CORRECTION

PATENT NO. : 5,096,334

DATED : March 17, 1992

INVENTOR(S) : Michael J. Plank

It is certified that error appears in the above—identified patent and that said Letters Patent is hereby corrected as shown below:

At column 12, line 48 delete -- "monitoring," --.

At column 13, line 16 -- "4" -- should read -- "5" --.

Signed and Sealed this

Twenty-first Day of September, 1993

Bruce Lehman

*Attest:*

BRUCE LEHMAN

*Attesting Officer*

*Commissioner of Patents and Trademarks*

US005096334B1

REEXAMINATION CERTIFICATE (3570th)

United States Patent [19]

Plank

[11] B1 5,096,334

[45] Certificate Issued Jul. 14, 1998

[54] SHORING SHIELD

[75] Inventor: Michael J. Plank, Houston, Tex.

[73] Assignee: Speed Shore Corporation, Houston, Tex.

Reexamination Request:
No. 90/003,056, May 12, 1993

Reexamination Certificate for:

| | |
|---|---|
| Patent No.: | **5,096,334** |
| Issued: | **Mar. 17, 1992** |
| Appl. No.: | **590,143** |
| Filed: | **Sep. 28, 1990** |

Certificate of Correction issued Sep. 29, 1993.

[51] Int. Cl.[6] ..... E02D 17/04

[52] U.S. Cl. ..... 405/283; 405/272; 405/282

[56] References Cited

U.S. PATENT DOCUMENTS

| | | | |
|---|---|---|---|
| 2,796,738 | 6/1957 | Moore | 405/282 |
| 2,922,283 | 1/1960 | Porter . | |
| 2,987,890 | 6/1961 | Droml | 405/283 |
| 3,204,415 | 9/1965 | Hill, Jr. et al. . | |
| 3,362,168 | 1/1968 | Dotlich | 61/41 |
| 3,470,699 | 10/1969 | Cox | 61/41 |
| 3,584,465 | 6/1971 | Holl | 405/282 X |
| 3,905,279 | 9/1975 | Yadon | 92/13.8 |
| 3,922,866 | 12/1975 | Benning | 405/283 |
| 4,058,983 | 11/1977 | Griswold | 405/283 |
| 4,059,964 | 11/1977 | Pavese | 405/282 |

FOREIGN PATENT DOCUMENTS 597438 4/1978 Switzerland .

OTHER PUBLICATIONS

1989 Safe–T–Shore brochure.

1971 Speed Shore safety brochure; at I–SS–9.

"Pile Buck Steel Sheet Piling Design Manual," cover page and pp. 1, 16, 27, 65, 85 and 129, published in 1987 by Pile Buck, Inc.

Eight–page color brochure entitled "Speed Shore", published in 1989 by Speed Shore Corporation.

Four–page black and white brochure entitled "Speed Shore Hydraulic Trench Shoring Systems", undated, published by Speed Shore (U.K.), Ltd.

*Primary Examiner*—Dennis L. Taylor

[57] ABSTRACT

The present invention comprises a lightweight, portable, adjustable, reusable, preassembled, hydraulic expandable shoring shield for providing safety to personnel working in below-grade excavations. The Shoring shield comprises specially designed solid aluminum extruded sheeting sections forming the walls, each mounted with a top cap and lower skid, the walls are provided with a static expandable telescoping structural framework for holding the walls opposed, and also are provided with hydraulic cylinders for expanding the space enclosed between the walls, the framework and cylinders thus cooperate in combination with an armored manifold for routing fluid to the cylinders.

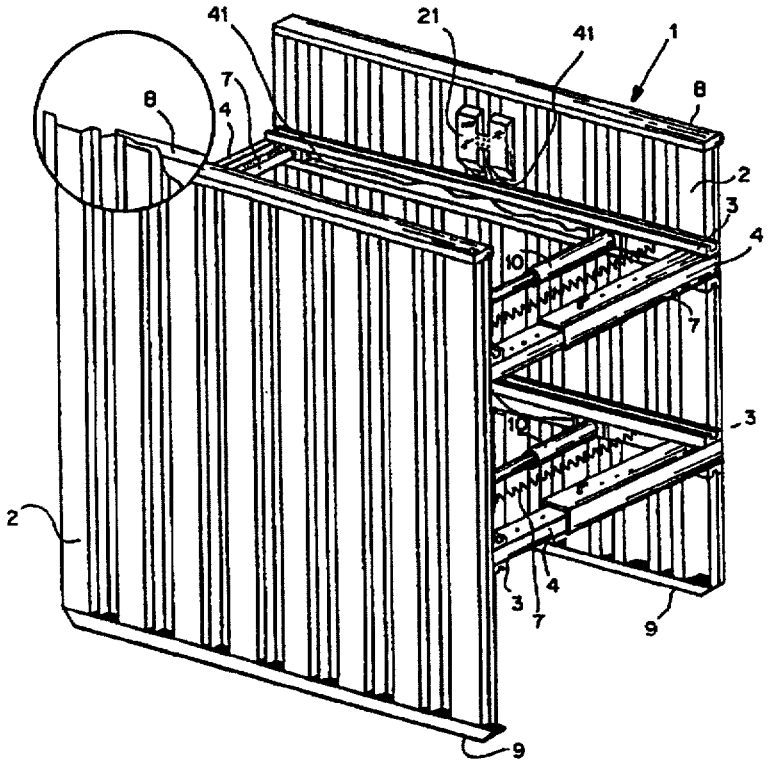

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–11 are cancelled.

New claims 12–14 are added and determined to be patentable.

*12. A device for shoring the walls of an open excavation comprising:*

*(a) spaced shield means for insertion into the excavation for support of opposing side walls of the open excavation;*

*(b) support means mounted upon each of said shield means;*

*(c) telescoping cross members mounted to said support means of each of said shield means and extending across the space to form a box like structure expandable in one direction across the width of the excavation;*

*(d) means for extending and contracting said cross members across the width of the excavation;*

*(e) means for selectively applying, adjusting and releasing a precise pressure to said open excavation walls and means comprising combination manifold means and valve means providing for at least one attachment point for a hydraulic pressure source;*

*(f) means for simultaneous supply of hydraulic pressure equally to each of said hydraulic cylinders and selective pressure to isolated cylinders;*

*(g) protective armor means for said combination manifold means and valve means;*

*(h) hydraulic lines for connection of said combination manifold and valve means to each of said hydraulic cylinders; and*

*(i) means for protecting substantially the entire length of each of said hydraulic lines.*

*13. A device for shoring the walls of an open excavation comprising:*

*(a) spaced shield means for insertion into the excavation for support of opposing side walls of the open excavation;*

*(b) support means mounted upon each of said shield means;*

*(c) telescoping cross members mounted to said support means of each of said shield means and extending across the space to form a box like structure expandable in one direction across the width of the excavation;*

*(d) means for extending and contracting said cross members across the width of the excavation;*

*(e) means for selectively applying, adjusting and releasing a precise pressure to said open excavation walls and means comprising combination manifold means and valve means providing for at least one attachment point for a hydraulic pressure source;*

*(f) said shield means compiling a pair of opposing; substantially continuous, rigid shield members containing solid panels of extruded corrugated aluminum with upper and lower edges; and*

*(g) cap and skid elements affixed to the upper and lower edges of said shield members respectively to provide a substantial increase in rigidity and positive protection for the shield means as well as to eliminate setting or digging of the sheeting into the trench, thereby allowing the shield members to move freely within the excavation.*

*14. The invention of claim 13 wherein;*

*(a) said shield members each further comprise a plurality of solid corrugated aluminum narrow panels which overlap each other along the length of each of said shield members;*

*(b) said support means comprising upper and lower support members mounted such that each of said narrow panels of said shield members is affixed independently to said support members for forming a solid braced wall for enhancing the strength, rigidity, and stability of the device to enable shoring of highly unstable and other soils; and*

*(c) said combination manifold and valve means maintains said shield means in fixed positions irrespective of the stability of the soil and the soil pressure exerted against each shield member at different positions along each rigid shield means.*

* * * * *